US010825382B2

(12) United States Patent
Kim et al.

(10) Patent No.: US 10,825,382 B2
(45) Date of Patent: Nov. 3, 2020

(54) DISPLAY APPARATUS AND METHOD OF DRIVING THE SAME

(71) Applicant: Samsung Display Co., Ltd., Yongin-si (KR)

(72) Inventors: Hong Soo Kim, Hwaseong-si (KR); Bon-Seog Gu, Suwon-si (KR); Woomi Bae, Daegu (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/696,368

(22) Filed: Nov. 26, 2019

(65) Prior Publication Data

US 2020/0211449 A1 Jul. 2, 2020

(30) Foreign Application Priority Data

Dec. 31, 2018 (KR) ..... 10-2018-0173938

(51) Int. Cl.
*G09G 3/32* (2016.01)

(52) U.S. Cl.
CPC ..... *G09G 3/32* (2013.01); *G09G 2310/0275* (2013.01); *G09G 2310/0289* (2013.01); *G09G 2330/028* (2013.01)

(58) Field of Classification Search
CPC .. G09G 3/30; G09G 3/32; G09G 3/34; G09G 3/36; G09G 5/02; G09G 5/00; G09G 3/10; G06F 3/038
See application file for complete search history.

(56) References Cited

U.S. PATENT DOCUMENTS

2006/0114193 A1* 6/2006 Kwak ..... G09G 3/3233 345/76
2015/0317952 A1 11/2015 Ohara et al.
2016/0012779 A1* 1/2016 Gu ..... G09G 3/3233 345/215

(Continued)

FOREIGN PATENT DOCUMENTS

EP 1 538 594 A2 6/2005
KR 10-2017-0047465 A 5/2017

OTHER PUBLICATIONS

Extended European Search Report for corresponding European Patent Application No. 20150127.7, dated Apr. 22, 2020, 10 pages.

*Primary Examiner* — Pegeman Karimi
(74) *Attorney, Agent, or Firm* — Lewis Roca Rothgerber Christie LLP

(57) ABSTRACT

A display apparatus includes a display panel and a power voltage generator. The display panel includes pixel circuits including a first light emitting element and a second light emitting element. The power voltage generator applies a high power voltage to first electrodes of the first light emitting element and the second light emitting element, a first low power voltage to a second electrode of the first light emitting element and a second low power voltage to a second electrode of the second light emitting element. The high power voltage has high level, the first low power voltage has low level and the second low power voltage has high level during an emission duration of a first frame. The high power voltage has the high level, the first low power voltage has high level and the second low power voltage has low level during an emission duration of a second frame.

20 Claims, 8 Drawing Sheets

(56) References Cited

U.S. PATENT DOCUMENTS

| | | | | |
|---|---|---|---|---|
| 2016/0086546 | A1* | 3/2016 | Noh | G09G 3/3258 345/80 |
| 2016/0293679 | A1* | 10/2016 | Xu | G09G 3/3225 |
| 2017/0061880 | A1* | 3/2017 | Choi | G09G 3/3233 |
| 2017/0076646 | A1* | 3/2017 | Gu | G09G 3/3266 |
| 2018/0137602 | A1 | 5/2018 | Spitzer et al. | |

* cited by examiner

DISPLAY APPARATUS AND METHOD OF DRIVING THE SAME

CROSS-REFERENCE TO RELATED APPLICATION

This application claims priority to and the benefit of Korean Patent Application No. 10-2018-0173938, filed on Dec. 31, 2018 in the Korean Intellectual Property Office KIPO, the entire content of which is herein incorporated by reference.

BACKGROUND

1. Field

Aspects of some example embodiments of the present inventive concept relate to a display apparatus and a method of driving the display apparatus.

2. Description of the Related Art

Generally, a display apparatus includes a display panel and a display panel driver. The display panel includes a plurality of gate lines, a plurality of data lines and a plurality of pixel circuits electrically connected to the gate lines and the data lines. The pixel circuit may include a light emitting element. The display panel driver includes a gate driver outputting gate signals to the gate lines, the data driver outputting data voltages to the data lines and a power voltage generator outputting a power voltage to the light emitting element.

Due to a current leakage of the light emitting element, a stain of the display panel may be generated in a low grayscale area. Due to the stain, a display quality of the display panel may be deteriorated.

The above information disclosed in this Background section is only for enhancement of understanding of the background and therefore it may contain information that does not constitute prior art.

SUMMARY

Aspects of some example embodiments of the present inventive concept relate to a display apparatus and a method of driving the display apparatus. For example, some example embodiments of the present inventive concept relate to a display apparatus capable of preventing or reducing a stain to enhance a display quality and increasing lifetime of a pixel circuit and a method of driving the display apparatus.

Some example embodiments of the present inventive concept include a display apparatus enhancing a display quality and increasing lifetime of a pixel circuit.

Some example embodiments of the present inventive concept also provide a method of driving the display apparatus.

According to some example embodiments of a display apparatus according to the present inventive concept, the display apparatus includes a display panel and a power voltage generator. The display panel includes a plurality of pixel circuits. The pixel circuit includes a first light emitting element and a second light emitting element. The power voltage generator is configured to apply a high power voltage to a first electrode of the first light emitting element and a first electrode of the second light emitting element, to apply a first low power voltage to a second electrode of the first light emitting element and to apply a second low power voltage to a second electrode of the second light emitting element. The high power voltage has a high level, the first low power voltage has a low level and the second low power voltage has a high level during an emission duration of a first frame. The high power voltage has the high level, the first low power voltage has a high level and the second low power voltage has a low level during an emission duration of a second frame. A waveform of the high power voltage in the emission duration of the first frame is different from a waveform of the high power voltage in the emission duration of the second frame.

According to some example embodiments, the high power voltage may maintain the high level during the emission duration of the first frame. The high power voltage may have an overdrive level greater than the high level in an initial period of the emission duration of the second frame.

According to some example embodiments, the first light emitting element may emit light during the emission duration of the first frame. The first light emitting element may be a red light emitting element or a blue light emitting element. The second light emitting element may emit light during the emission duration of the second frame. The second light emitting element may be a green light emitting element.

According to some example embodiments, the waveform of the high power voltage in the initial period of the emission duration of the second frame may have a plurality of pulses having the overdrive level.

According to some example embodiments, the high power voltage may have a first overdrive level greater than the high level in an initial period of the emission duration of the first frame. The high power voltage may have a second overdrive level greater than the first overdrive level in an initial period of the emission duration of the second frame.

According to some example embodiments, the first light emitting element may emit light during the emission duration of the first frame. The first light emitting element may be a red light emitting element or a blue light emitting element. The second light emitting element may emit light during the emission duration of the second frame. The second light emitting element may be a green light emitting element.

According to some example embodiments, the waveform of the high power voltage in the initial period of the emission duration of the first frame may have a plurality of pulses having the first overdrive level. The waveform of the high power voltage in the initial period of the emission duration of the second frame may have a plurality of pulses having the second overdrive level.

According to some example embodiments, the pixel circuit may further include a first switching element comprising a control electrode electrically connected to a first node, an input electrode to which the high power voltage is applied and an output electrode electrically connected to the first electrode of the first light emitting element, a second switching element comprising a control electrode to which a gate compensating signal is applied, an input electrode electrically connected to an output electrode of a third switching element and an output electrode electrically connected to the first electrode of the first light emitting element and the third switching element comprising a control electrode to which a gate writing signal is applied, an input electrode electrically connected to the first node and an output electrode electrically connected to the input electrode of the second switching element.

According to some example embodiments, the pixel circuit may further include a first capacitor comprising a first electrode to which an initialization voltage is applied and a second electrode electrically connected to the first node and a second capacitor comprising a first electrode electrically connected to the output electrode of the third switching element and a second electrode electrically connected to a data line.

According to some example embodiments, the display panel may include a first subpixel row comprising a first subpixel which is a red subpixel, a second subpixel which is a green subpixel, a third subpixel which is a blue subpixel and a fourth subpixel which is a green subpixel and a second subpixel row comprising a fifth subpixel which is a blue subpixel, a sixth subpixel which is a green subpixel, a seventh subpixel which is a red subpixel and an eighth subpixel which is a green subpixel.

According to some example embodiments, the display panel may further include a first data line electrically connected to the first subpixel, the second subpixel, the fifth subpixel and the sixth subpixel and a second data line electrically connected to the third subpixel, the fourth subpixel, the seventh subpixel and the eighth subpixel.

According to some example embodiments, the high power voltage may have a low level, the first low power voltage may have the high level and the second low power voltage may have the high level during a programming duration of the first frame which precedes the emission duration of the first frame.

According to some example embodiments, the high power voltage may have the low level, the first low power voltage may have the high level and the second low power voltage may have the high level during an on bias duration of the second frame which is subsequent to the emission duration of the first frame.

According to some example embodiments of a display apparatus according to the present inventive concept, the display apparatus includes a display panel and a power voltage generator. The display panel includes a plurality of pixel circuits. The pixel circuit includes a first light emitting element and a second light emitting element. The power voltage generator is configured to apply a high power voltage to a first electrode of the first light emitting element and a first electrode of the second light emitting element, to apply a first low power voltage to a second electrode of the first light emitting element and to apply a second low power voltage to a second electrode of the second light emitting element. The high power voltage has a high level, the first low power voltage has a low level and the second low power voltage has a high level during an emission duration of a first frame. The high power voltage has the high level, the first low power voltage has a high level and the second low power voltage has a low level during an emission duration of a second frame. A waveform of the first low power voltage in the emission duration of the first frame is different from a waveform of the second low power voltage in the emission duration of the second frame.

According to some example embodiments, a width of a second low duration when the second low power voltage has the low level in the emission duration of the second frame may be less than a width of a first low duration when the first low power voltage has the low level in the emission duration of the first frame.

According to some example embodiments, the first light emitting element may emit light during the emission duration of the first frame. The first light emitting element may be a red light emitting element or a blue light emitting element. The second light emitting element may emit light during the emission duration of the second frame. The second light emitting element may be a green light emitting element.

According to some example embodiments of a method of driving a display apparatus according to the present inventive concept, the method includes applying a high power voltage to a first electrode of a first light emitting element and a first electrode of a second light emitting element, applying a first low power voltage to a second electrode of the first light emitting element and applying a second low power voltage to a second electrode of the second light emitting element. The high power voltage has a high level, the first low power voltage has a low level and the second low power voltage has a high level during an emission duration of a first frame. The high power voltage has the high level, the first low power voltage has a high level and the second low power voltage has a low level during an emission duration of a second frame. A waveform of the high power voltage in the emission duration of the first frame is different from a waveform of the high power voltage in the emission duration of the second frame.

According to some example embodiments, the high power voltage may maintain the high level during the emission duration of the first frame. The high power voltage may have an overdrive level greater than the high level in an initial period of the emission duration of the second frame.

According to some example embodiments, the high power voltage may have a first overdrive level greater than the high level in an initial period of the emission duration of the first frame. The high power voltage may have a second overdrive level greater than the first overdrive level in an initial period of the emission duration of the second frame.

According to some example embodiments, the pixel circuit may include the first light emitting element, the second light emitting element, a first switching element comprising a control electrode electrically connected to a first node, an input electrode to which the high power voltage is applied and an output electrode electrically connected to the first electrode of the first light emitting element, a second switching element comprising a control electrode to which a gate compensating signal is applied, an input electrode electrically connected to an output electrode of a third switching element and an output electrode electrically connected to the first electrode of the first light emitting element and the third switching element comprising a control electrode to which a gate writing signal is applied, an input electrode electrically connected to the first node and an output electrode electrically connected to the input electrode of the second switching element.

Accordingly, in a display apparatus and the method of driving the display apparatus, an overdriven high power voltage may be applied to the pixel circuit in an initial period of an emission duration so that pixel uniformity may be enhanced in a low grayscale image. In addition, an overdriving method may be selectively applied to specific color light emitting elements or a degree of overdriving is varied according to color of the light emitting elements so that the pixel uniformity may be enhanced, light emitting delay of the specific color light emitting element may be enhanced and decrease of the lifetime of the specific color light emitting element may be prevented or reduced.

Thus, according to some example embodiments, the display quality of the display panel may be enhanced and the lifetime of the display apparatus may be increased.

BRIEF DESCRIPTION OF THE DRAWINGS

The above and other features and characteristic of the present inventive concept will become more apparent by describing in some detail aspects of example embodiments thereof with reference to the accompanying drawings, in which.

DETAILED DESCRIPTION

Hereinafter, aspects of some example embodiments of the present inventive concept will be explained in more detail with reference to the accompanying drawings.

Figure 1:
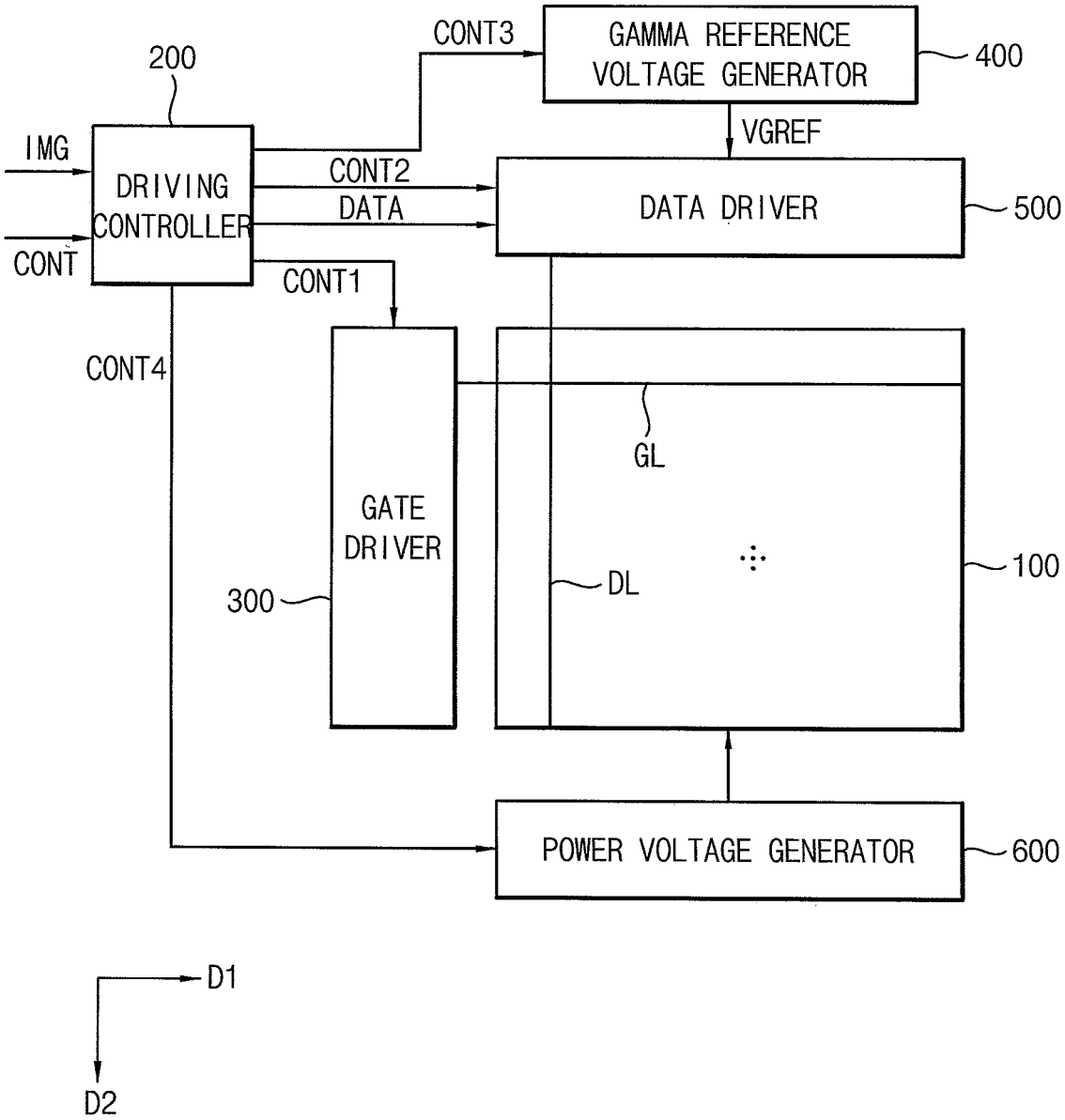
FIG. 1 is a block diagram illustrating a display apparatus according to some example embodiments of the present inventive concept.

FIG. 1 is a block diagram illustrating a display apparatus according to some example embodiments of the present inventive concept.

Referring to FIG. 1, the display apparatus includes a display panel 100 and a display panel driver. The display panel driver includes a driving controller 200, a gate driver 300, a gamma reference voltage generator 400, a data driver 500 and a power voltage generator 600.

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. The input image data may include red image data, green image data and blue image data. The input image data may include white image data. The input image data may include magenta image data, yellow image data and cyan image data. The input control signal CONT may include a master clock signal and a data enable signal. The input control signal CONT may include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the power voltage generator 600 based on the input control signal CONT, and outputs the fourth control signal CONT4 to the power voltage generator 600.

The gate driver 300 generates gate signals driving the gate lines GL in response to the first control signal CONT1 received from the driving controller 200. The gate driver 300 sequentially outputs the gate signals to the gate lines GL.

The gate driver 300 may be directly mounted on the display panel 100, or may be connected to the display panel 100 as a tape carrier package ("TCP") type. Alternatively, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

According to some example embodiments, the gamma reference voltage generator 400 may be arranged in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may be directly mounted on the display panel 100, or be connected to the display panel 100 in a TCP type. Alternatively, the data driver 500 may be integrated on the display panel 100.

The power voltage generator 600 may receive the fourth control signal CONT4. The power voltage generator 600 may generate a power voltage of the display panel 100 in response to the fourth control signal CONT4 and output the power voltage to the display panel 100. For example, the power voltage generator 600 may generate a high power voltage of a light emitting element of the display panel 100 and a low power voltage of the light emitting element of the display panel 100. The power voltage generator 600 may output the high power voltage and the low power voltage of the light emitting element to the display panel 100.

The power voltage generator 600 may generate a power voltage of the gate driver 300 and output the power voltage to the gate driver 300. For example, the power voltage generator 600 may generate a gate on voltage, a first gate off voltage and a second gate off voltage and output the gate on voltage, the first gate off voltage and the second gate off voltage to the gate driver 300.

The power voltage generator 600 may generate a power voltage of the data driver 500 and output the power voltage to the data driver 500.

The power voltage generator 600 may generate a power voltage of the driving controller 200 and output the power voltage to the driving controller 200.

Figure 2:
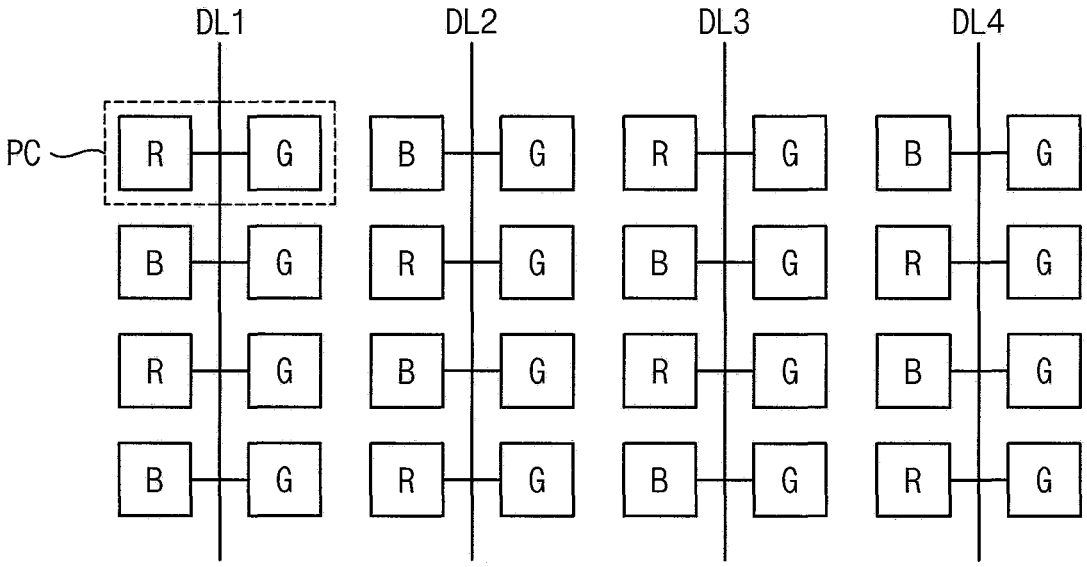
FIG. 2 is a conceptual diagram illustrating a display panel of FIG. 1 according to some example embodiments of the present inventive concept.

FIG. 2 is a conceptual diagram illustrating the display panel 100 of FIG. 1.

Referring to FIGS. 1 and 2, the display panel 100 includes subpixels arranged in a matrix form or structure.

For example, the display panel 100 may include a subpixel repeating group arranged in a row direction and in a column direction. For example, the subpixel repeating group may include eight subpixels forming a two by four matrix.

The subpixel repeating group may include a first subpixel row including a first subpixel which is a red subpixel, a second subpixel which is a green subpixel, a third subpixel which is a blue subpixel and a fourth subpixel which is a green subpixel and a second subpixel row including a fifth subpixel which is a blue subpixel, a sixth subpixel which is a green subpixel, a seventh subpixel which is a red subpixel, and an eighth subpixel which is a green subpixel.

A first data line DL1 of the display panel 100 may be electrically connected to the first subpixel, the second subpixel, the fifth subpixel, and the sixth subpixel. A second data line DL2 of the display panel 100 may be electrically connected to the third subpixel, the fourth subpixel, the seventh subpixel, and the eighth subpixel.

Along a first subpixel column, red subpixels, and blue subpixels are alternately arranged. Along a second subpixel column, green subpixels are arranged. Along a third subpixel column, blue subpixels, and red subpixels are alternately arranged. Along a fourth subpixel column, green subpixels are arranged.

According to some example embodiments, two adjacent subpixels may form a single pixel circuit PC.

Figure 3:
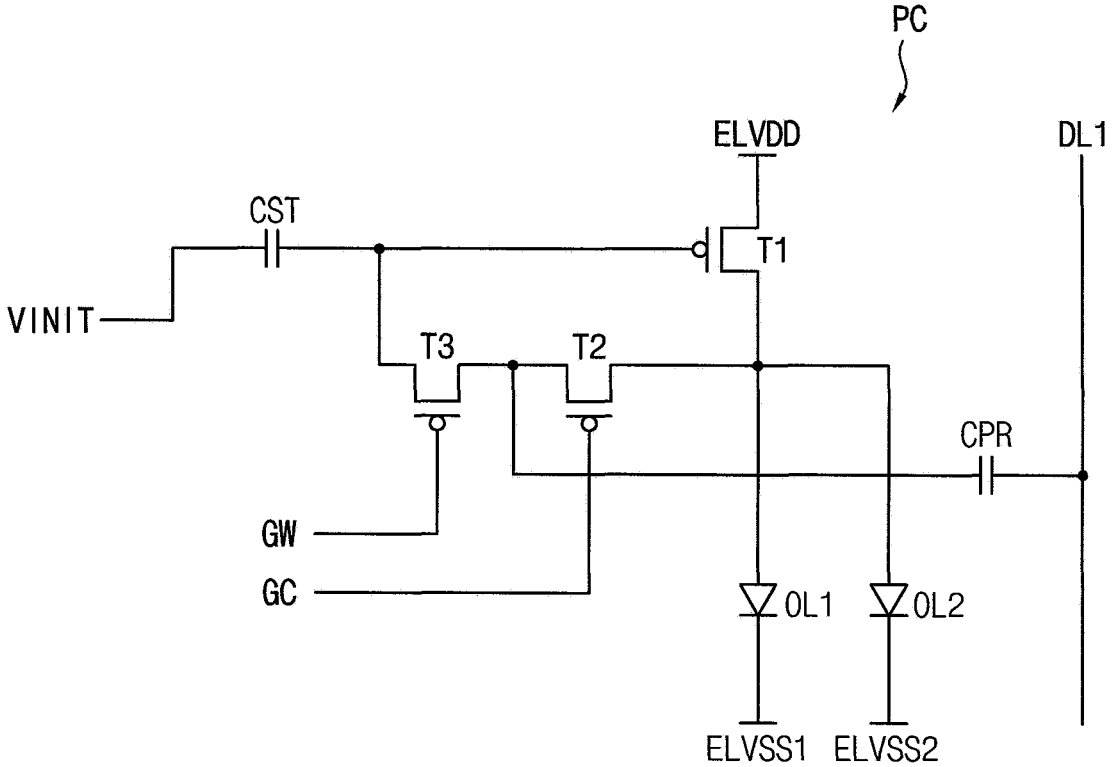
FIG. 3 is a circuit diagram illustrating a pixel circuit of FIG. 2 according to some example embodiments of the present inventive concept.

FIG. 3 is a circuit diagram illustrating the pixel circuit PC of FIG. 2.

Referring to FIGS. 1 to 3, the pixel circuit PC includes a first light emitting element OL1 and a second light emitting element OL2. A first electrode of the first light emitting element OL1 is electrically connected to a first electrode of the second light emitting element OL2.

For example, the first light emitting element OL1 may be a red light emitting element and the second light emitting element OL2 may be green light emitting element. For example, the first light emitting element OL1 may be a blue light emitting element and the second light emitting element OL2 may be green light emitting element. When the pixel circuit includes the first subpixel and the second subpixel of FIG. 2, the first light emitting element OL1 is a red light emitting element and the second light emitting element OL2 is a green light emitting element. When the pixel circuit includes the third subpixel and the fourth subpixel of FIG. 2, the first light emitting element OL1 is a blue light emitting element and the second light emitting element OL2 is a green light emitting element.

The power voltage generator 600 applies a high power voltage ELVDD to the first electrode of the first light emitting element OL1 and the first electrode of the second light emitting element OL2. The power voltage generator 600 applies a first low power voltage ELVSS1 to a second electrode of the first light emitting element OL1. The power voltage generator 600 applies a second low power voltage ELVSS2 to a second electrode of the second light emitting element OL2.

The pixel circuit PC may further include a first switching element T1, a second switching element T2, and a third switching element T3. The first switching element T1 includes a control electrode electrically connected to a first node, an input electrode to which the high power voltage ELVDD is applied and an output electrode electrically connected to the first electrode of the first light emitting element OL1. The second switching element T2 includes a control electrode to which a gate compensating signal GC is applied, an input electrode electrically connected to an output electrode of the third switching element T3 and an output electrode electrically connected to the first electrode of the first light emitting element OL1. The third switching element T3 includes a control electrode to which a gate writing signal GW is applied, an input electrode electrically connected to the first node and an output electrode electrically connected to the input electrode of the second switching element T2.

The pixel circuit PC may further include a first capacitor CST and a second capacitor CPR. The first capacitor CST includes a first electrode to which an initialization voltage VINIT is applied and a second electrode electrically connected to the first node. The second capacitor CPR includes a first electrode electrically connected to the output electrode of the third switching element T3 and a second electrode electrically connected to the data line DL1.

Figure 4:
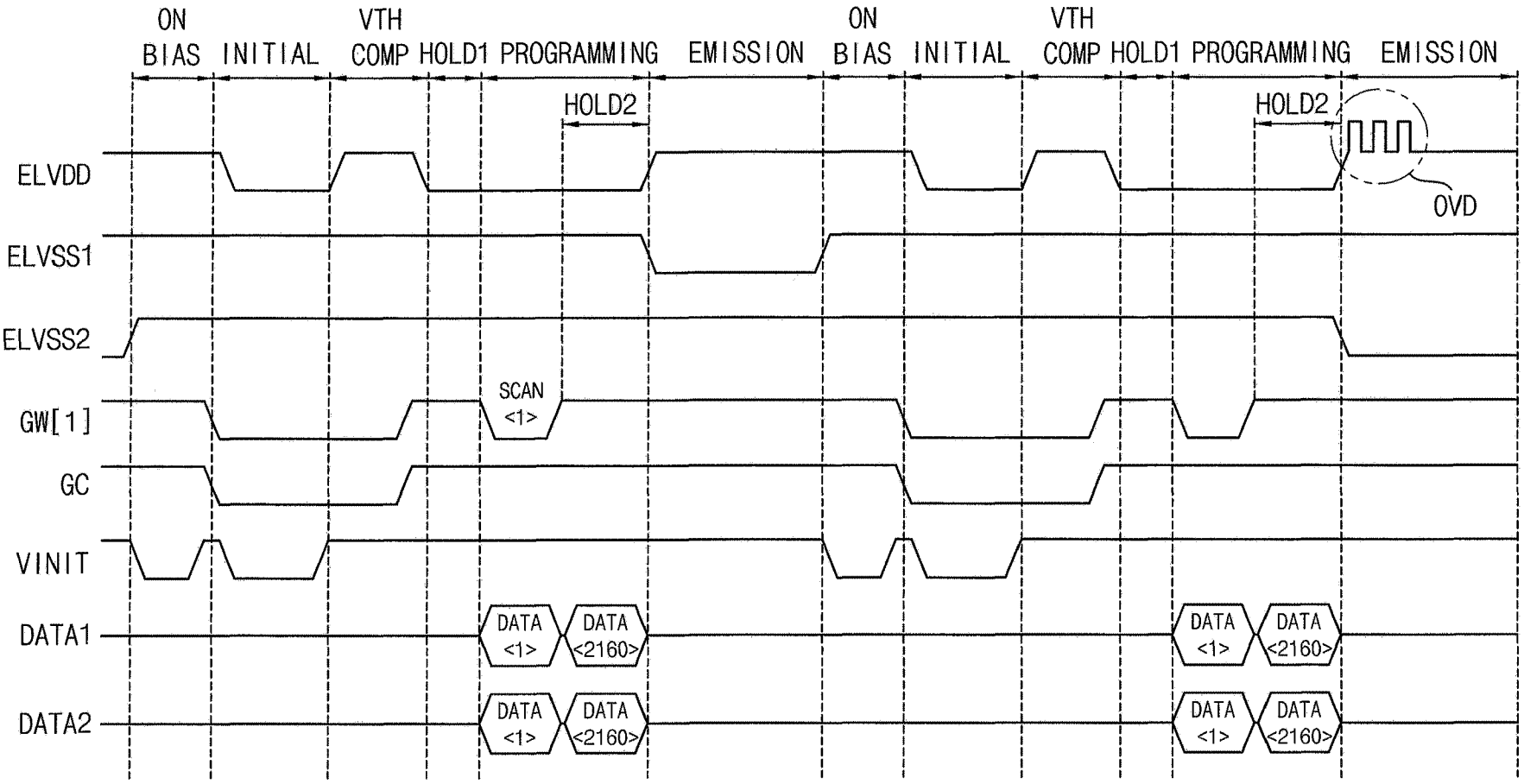
FIG. 4 is a timing diagram illustrating signals applied to the pixel circuit of FIG. 2 according to some example embodiments of the present inventive concept.
Figure 5:
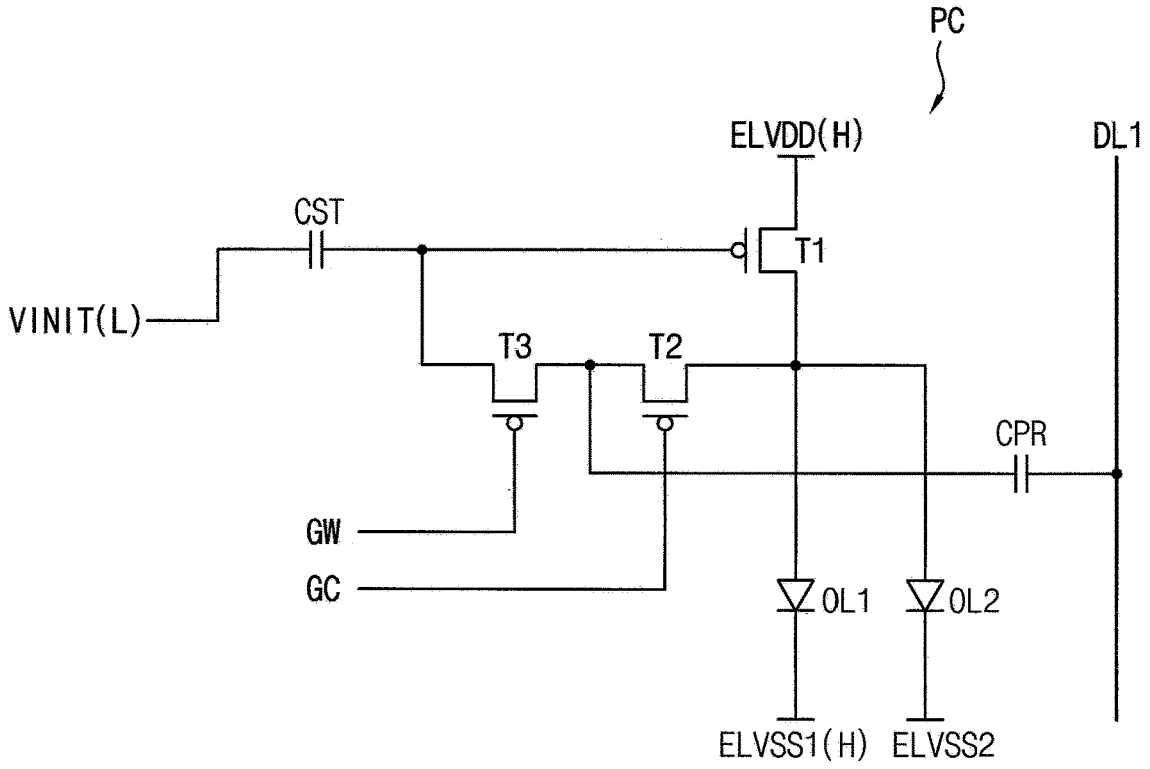
FIG. 5 is a circuit diagram illustrating an operation of the pixel circuit of FIG. 2 in an on bias duration according to some example embodiments of the present inventive concept.
Figure 6:
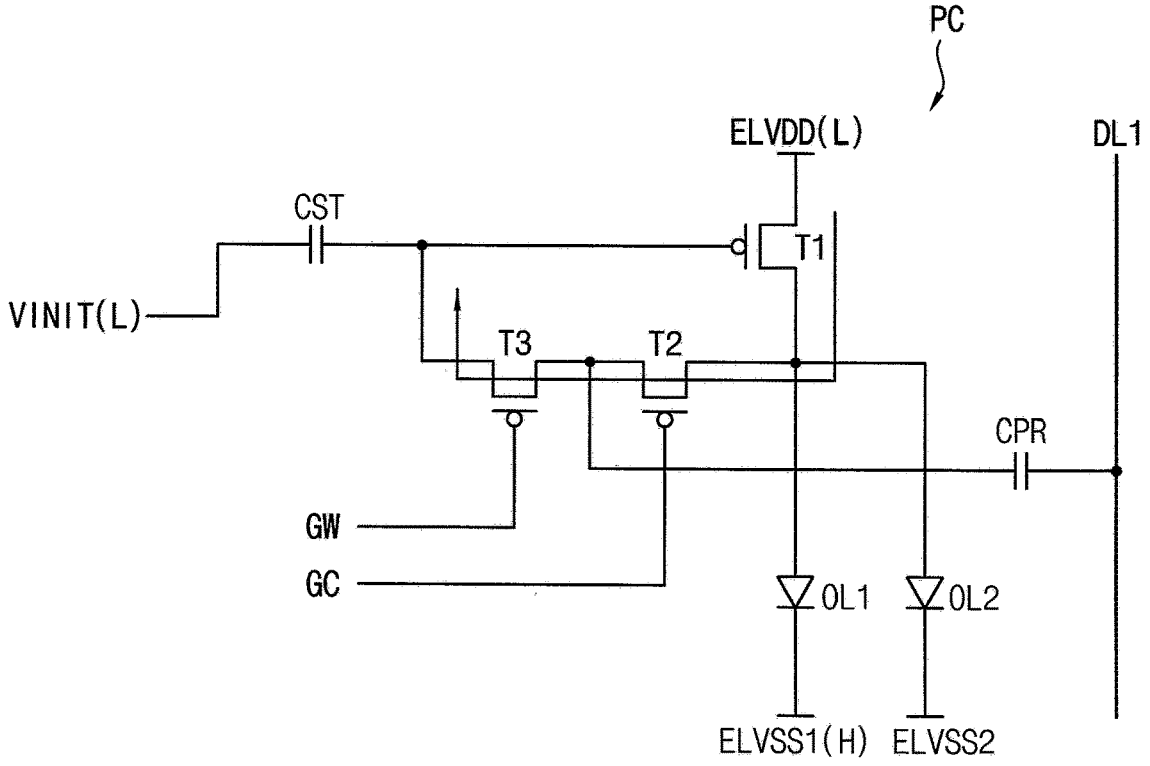
FIG. 6 is a circuit diagram illustrating an operation of the pixel circuit of FIG. 2 in an initial duration according to some example embodiments of the present inventive concept.
Figure 7:
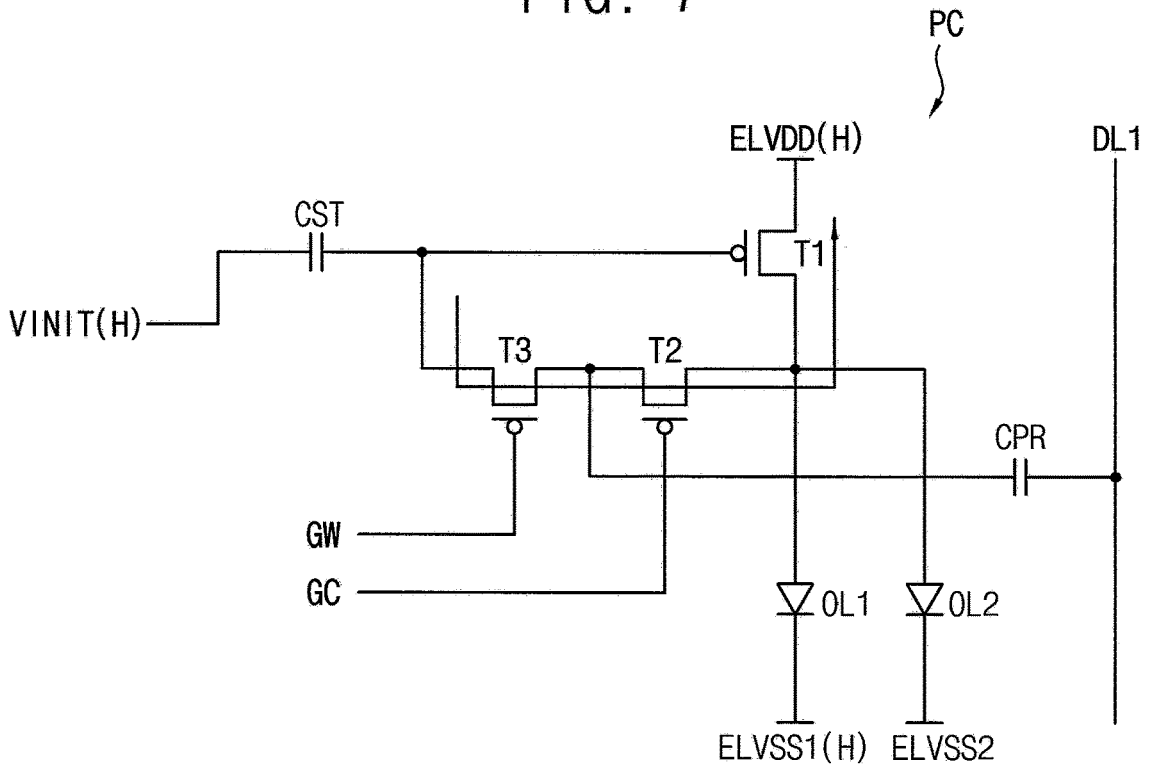
FIG. 7 is a circuit diagram illustrating an operation of the pixel circuit of FIG. 2 in a compensation duration according to some example embodiments of the present inventive concept.
Figure 8:
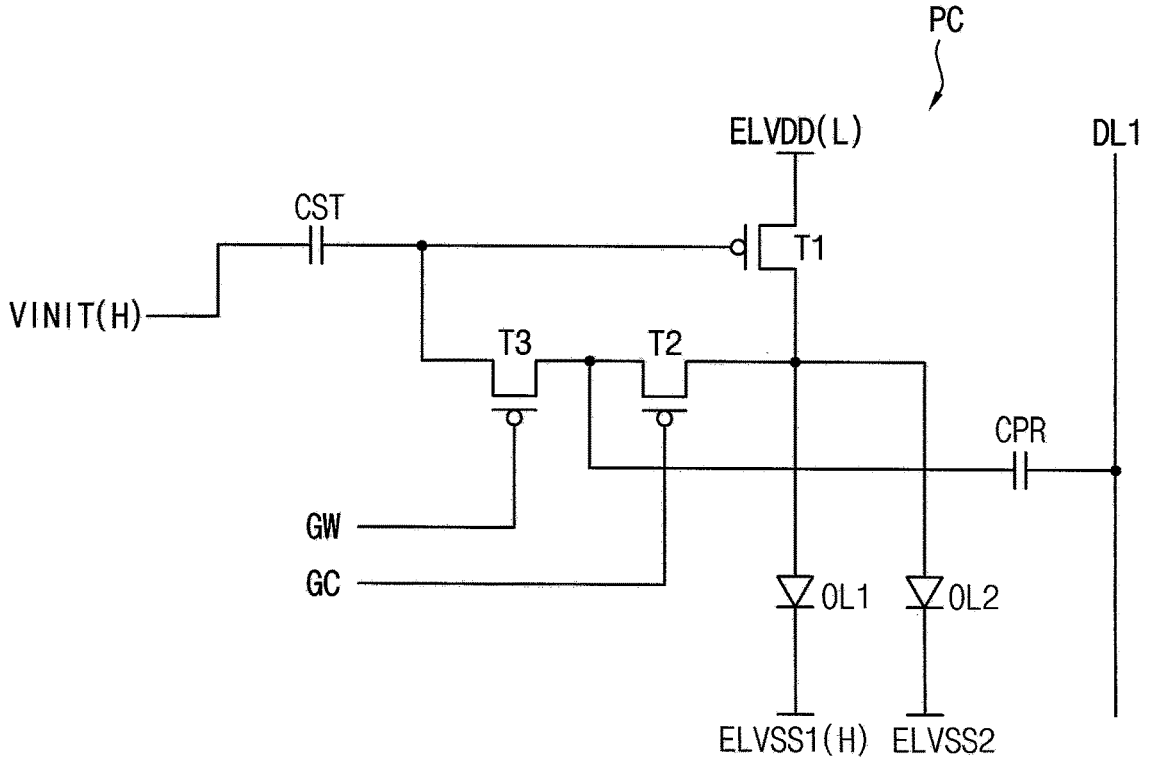
FIG. 8 is a circuit diagram illustrating an operation of the pixel circuit of FIG. 2 in a first holding duration according to some example embodiments of the present inventive concept.
Figure 9:
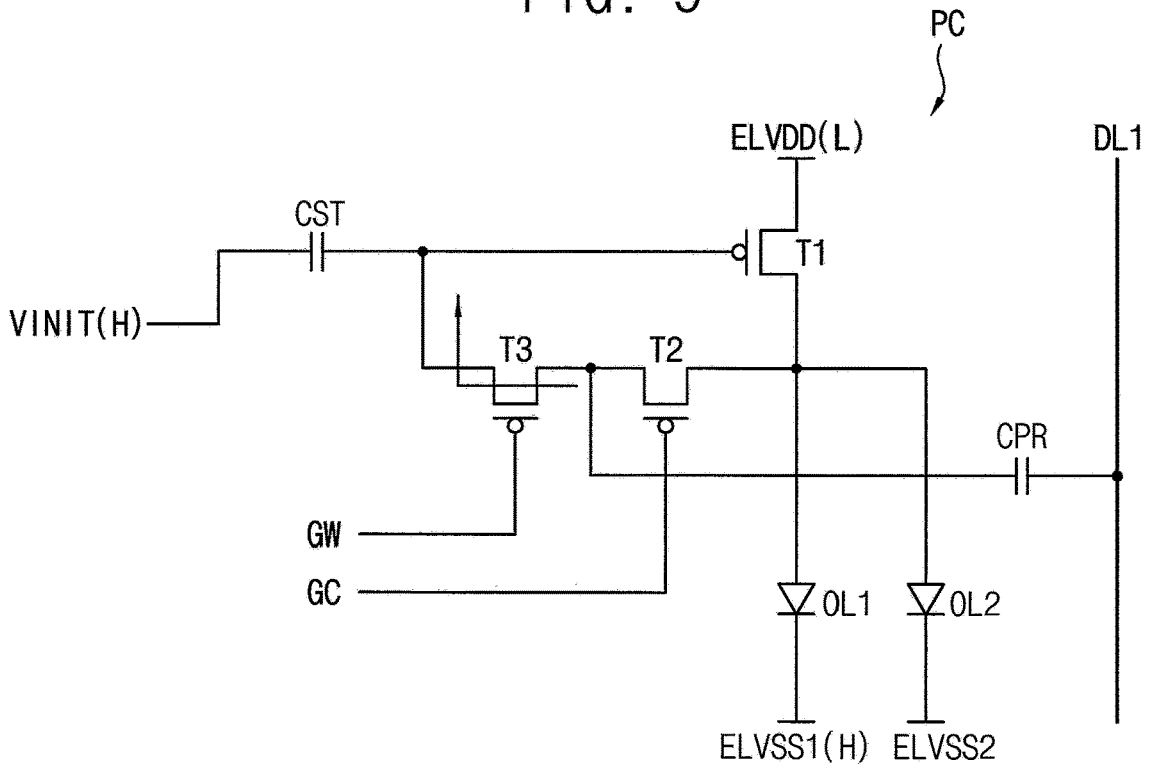
FIG. 9 is a circuit diagram illustrating an operation of the pixel circuit of FIG. 2 in a programming duration according to some example embodiments of the present inventive concept.
Figure 10:
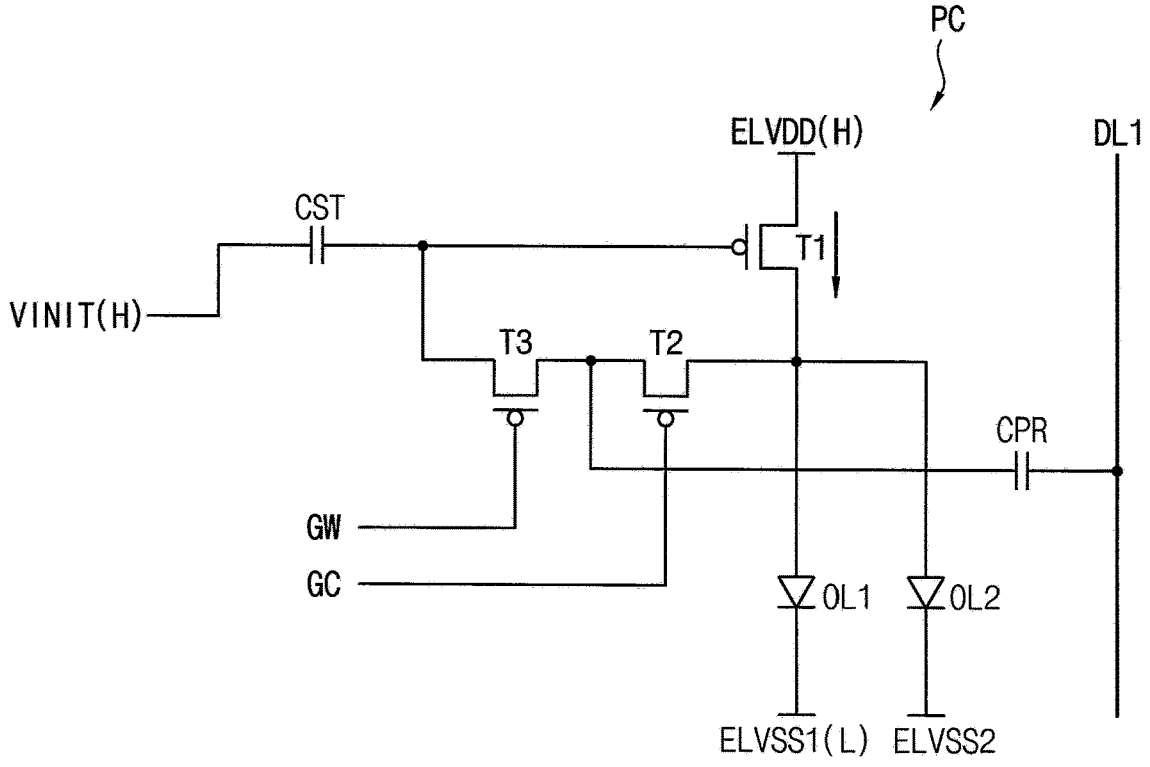
FIG. 10 is a circuit diagram illustrating an operation of the pixel circuit of FIG. 2 in an emission duration according to some example embodiments of the present inventive concept.

FIG. 4 is a timing diagram illustrating signals applied to the pixel circuit PC of FIG. 2. FIG. 5 is a circuit diagram illustrating an operation of the pixel circuit PC of FIG. 2 in an on bias duration (or time period). FIG. 6 is a circuit diagram illustrating an operation of the pixel circuit PC of FIG. 2 in an initial duration. FIG. 7 is a circuit diagram illustrating an operation of the pixel circuit PC of FIG. 2 in a compensation duration. FIG. 8 is a circuit diagram illustrating an operation of the pixel circuit PC of FIG. 2 in a first holding duration. FIG. 9 is a circuit diagram illustrating an operation of the pixel circuit PC of FIG. 2 in a programming duration. FIG. 10 is a circuit diagram illustrating an operation of the pixel circuit PC of FIG. 2 in an emission duration.

Referring to FIGS. 1 to 10, the pixel circuit PC is driven in a unit of a frame. The frame includes the on bias duration, the initial duration, the compensation duration, the first holding duration, the programming duration and the emission duration.

The first light emitting element OL1 of the pixel circuit PC may emit the light during a first frame and the second light emitting element OL2 of the pixel circuit PC may emit the light during a second frame. In a viewpoint of the entire display panel 100, red light emitting elements and blue light emitting elements of the display panel 100 emit the light during the first frame and green light emitting elements of the display panel 100 emit the light during the second frame. The first frame and the second frame may be respectively referred as a first subframe and a second subframe.

During the emission duration of the first frame, the high power voltage ELVDD commonly applied to the first light emitting element OL1 and the second light emitting element OL2 has a high level, the first low power voltage ELVSS1 applied to the first light emitting element OL1 has a low level and the second low power voltage ELVSS2 applied to the second light emitting element OL2 has a high level. A light emitting element emit the light when the high power voltage applied to the light emitting element has a high level and the low power voltage applied to the light emitting element has a low level. Thus, during the emission duration of the first frame, the first light emitting element OL1 emits the light. In contrast, during the emission duration of the first frame, the second light emitting element OL2 does not emit the light.

During the emission duration of the second frame, the high power voltage ELVDD commonly applied to the first light emitting element OL1 and the second light emitting element OL2 has a high level, the first low power voltage ELVSS1 applied to the first light emitting element OL1 has a high level and the second low power voltage ELVSS2 applied to the second light emitting element OL2 has a low level. Thus, during the emission duration of the second frame, the second light emitting element OL2 emits the light. In contrast, during the emission duration of the second frame, the first light emitting element OL1 does not emit the light.

Hereinafter, the on bias duration ON BIAS, the initial duration INITIAL, the compensation duration VTH COMP, the first holding duration HOLD1, the programming duration PROGRAMMING and the emission duration EMISSION are explained referring to FIGS. 5 to 10. According to some example embodiments, the second low power voltage ELVSS2 may maintain the high level during the above durations.

During the on bias duration ON BIAS, an on bias voltage is applied (VINIT=L) to the first switching element T1 to enhance the hysteresis characteristics of the first switching element T1. In addition, the first low power voltage ELVSS1 has the high level so that the first light emitting element OL1 does not emit the light during the on bias duration ON BIAS.

During the initial duration INITIAL, all of the initialization voltage VINIT, the gate compensating signal GC and the gate writing signal GW have the low level so that all of the first switching element T1, the second switching element T2 and the third switching element T3 are turned on. During the initial duration INITIAL, the high power voltage ELVDD has the low level, the low level of the high power voltage ELVDD is greater than the voltage of the control electrode of the first switching element T1 and the control electrode of the first switching element T1 is initialized.

During the compensation duration VTH COMP, a threshold voltage of the first switching element T1 may be compensated. During the compensation duration VTH COMP, the level of the high power voltage ELVDD increases to the high level so that the threshold voltage of the first switching element T1 is compensated by a diode connection of the first switching element T1.

When the high level of the high power voltage is ELVDD_H and the threshold voltage of the first switching element T1 is |VTH|, the voltage of the control electrode of the first switching element T1 may be ELVDD_H−|VTH|.

During the first holding duration HOLD1, the level of the high power voltage ELVDD decreases to the low level and both the gate compensating signal GC and the gate writing signal GW have the high level. During the first holding duration HOLD1, the voltage of the control electrode of the first switching element T1 is temporarily held to ELVDD_H−|VTH|.

During the programming duration PROGRAMMING, the data voltage VDATA is written to the control electrode of the first switching element T1 through the data line DL1. During the programming duration PROGRAMMING, the data voltage VDATA is applied to the data line DL1, the gate compensating signal GC has the high level and the gate writing signal GW has the low level. Thus, the second switching element T2 is turned off, the third switching element T3 is turned on and the voltage of the control electrode of the first switching element T1 is ELVDD_H−|VTH|+a ΔVDATA.

Herein, a is determined by a capacitance of the first capacitor CST and a capacitance of the second capacitor CPR. a is determined according to Formula 1 as follows:

$$\frac{CPR}{CST + CPR} \qquad \text{Formula 1}$$

During the programming duration PROGRAMMING, the high power voltage ELVDD may have the low level and the first low power voltage ELVSS1 may have the high level so that the first light emitting element OL1 may not emit the light.

During the programming duration PROGRAMMING, the pixel circuits PC may be sequentially programmed along a row direction. A duration after the data voltage VDATA is written in the programming duration PROGRAMMING may be referred as a second holding duration HOLD2.

During the emission duration EMISSION, the subpixels simultaneously emit the light. As explained above, the first light emitting element OL1 emits the light during the emission duration EMISSION of the first frame and the second light emitting element OL2 emits the light during the emission duration EMISSION of the second frame.

During the emission duration EMISSION of the first frame, the initialization voltage VINIT has the high level, the high power voltage ELVDD has the high level and the first low power voltage ELVSS1 has the low level so that the first light emitting element OL1 emits the light based on the data voltage which is written during the programming duration PROGRAMMING of the first frame.

Similarly, during the emission duration EMISSION of the second frame, the initialization voltage VINIT has the high level, the high power voltage ELVDD has the high level and the second low power voltage ELVSS2 has the low level so that the second light emitting element OL2 emits the light based on the data voltage which is written during the programming duration PROGRAMMING of the second frame.

According to some example embodiments, a waveform of the high power voltage ELVDD during the emission duration EMISSION of the first frame is different from a waveform of the high power voltage ELVDD during the emission duration EMISSION of the second frame.

During the emission duration EMISSION of the first frame, the high power voltage ELVDD maintains the high level. In contrast, during the emission duration EMISSION of the second frame, the high power voltage ELVDD has an overdrive level which is greater than the high level. A duration when the high power voltage ELVDD has the overdrive level may be referred as an overdriving duration OVD.

During the emission duration EMISSION of the first frame, the first light emitting element OL1 emits the light. Herein the first light emitting element OL1 may be the red light emitting element or the blue light emitting element. During the emission duration EMISSION of the second frame, the second light emitting element OL2 emits the light. Herein the second light emitting element OL2 may be the green light emitting element.

During the emission duration EMISSION when the red light emitting elements and the blue light emitting elements emit the light, the high power voltage ELVDD may not be overdriven. In contrast, during the emission duration EMISSION when the green light emitting elements emit the light, the high power voltage ELVDD may be overdriven.

When the display panel 100 displays a low grayscale image, some of pixels may be turned on and some of pixels may not be turned on due to variance of characteristics of the switching elements of the pixel circuit and light emitting delay according to the color of the pixel so that the stain of the display panel 100 may be generated.

The light emitting delay of the green light emitting element is greater than the light emitting delay of the red light emitting element and the light emitting delay of the blue light emitting element so that only the green light emitting element may be overdriven to prevent or reduce the stain.

In addition, the lifetime of the green light emitting element is longer than the lifetime of the red light emitting element and the lifetime of the blue light emitting element. Thus, the lifetime of the display apparatus may not be decreased although only the green light emitting element is overdriven.

In addition, luminance component of the green light emitting element may be greatest among luminance components of the red light emitting element, the green light emitting element and the blue light emitting element. Thus, when the stain of the green light emitting element is prevented or reduced, the stain of the display panel 100 in the low grayscale image may be effectively prevented or reduced.

A waveform of the high power voltage ELVDD in an initial period of the emission duration EMISSION of the second frame may have a plurality of pulses which have the overdrive level. When the waveform of the high power voltage ELVDD has the plural pulses which have the overdrive level, the degree of overdriving may be increased compared to the waveform of the high power voltage ELVDD has a single pulse which has the overdrive level.

According to some example embodiments, the overdriven high power voltage is applied to the pixel circuit in the initial period of the emission duration EMISSION so that pixel uniformity may be enhanced in the low grayscale image. In addition, the overdriving method is selectively applied to the specific color light emitting elements so that the pixel uniformity may be enhanced, the light emitting delay of the specific color light emitting element may be enhanced and a decrease of the lifetime of the specific color light emitting element may be prevented. Thus, the display quality of the display panel 100 may be enhanced and the lifetime of the display apparatus may be increased.

Figure 11:
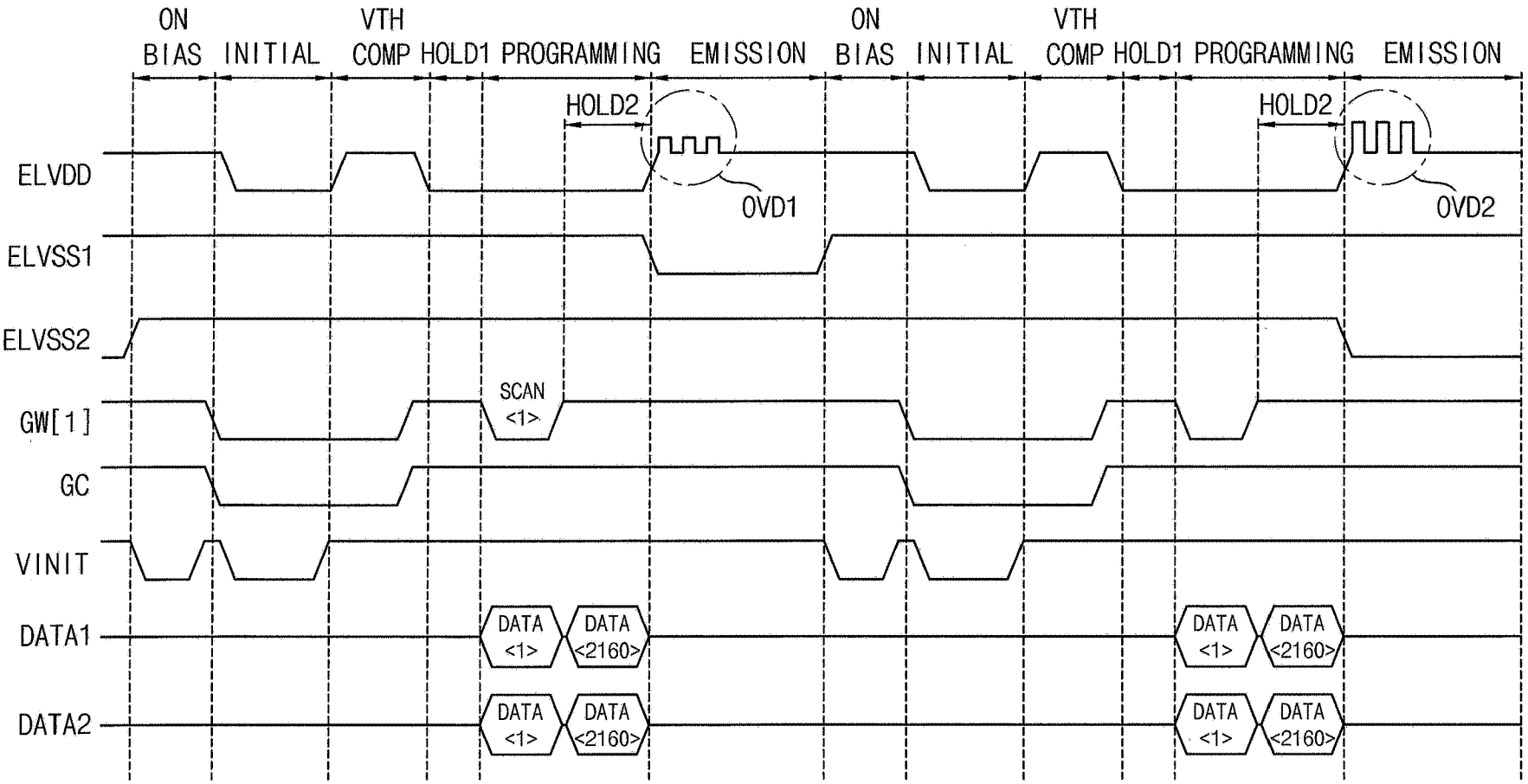
FIG. 11 is a timing diagram illustrating signals applied to a pixel circuit of a display apparatus according to some example embodiments of the present inventive concept.

FIG. 11 is a timing diagram illustrating signals applied to a pixel circuit of a display apparatus according to some example embodiments of the present inventive concept.

The display apparatus and the method of driving the display apparatus according to some example embodiments is substantially the same as the display apparatus and the method of driving the display apparatus of the previous example embodiment explained referring to FIGS. 1 to 10 except for the signals applied to the pixel circuit. Thus, the same reference numerals will be used to refer to the same or like parts as those described in the previous example embodiment of FIGS. 1 to 10 and any some repetitive explanation concerning the above elements will be omitted.

Referring to FIGS. 1 to 3 and 5 to 11, the display apparatus includes a display panel 100 and a display panel driver. The display panel driver includes a driving controller 200, a gate driver 300, a gamma reference voltage generator 400, a data driver 500 and a power voltage generator 600.

The pixel circuit PC includes a first light emitting element OL1 and a second light emitting element OL2. A first electrode of the first light emitting element OL1 is electrically connected to a first electrode of the second light emitting element OL2.

The pixel circuit PC may further include a first switching element T1, a second switching element T2 and a third switching element T3. The first switching element T1 includes a control electrode electrically connected to a first node, an input electrode to which the high power voltage ELVDD is applied and an output electrode electrically connected to the first electrode of the first light emitting element OL1. The second switching element T2 includes a control electrode to which a gate compensating signal GC is applied, an input electrode electrically connected to an output electrode of the third switching element T3 and an output electrode electrically connected to the first electrode of the first light emitting element OL1. The third switching element T3 includes a control electrode to which a gate writing signal GW is applied, an input electrode electrically connected to the first node and an output electrode electrically connected to the input electrode of the second switching element T2.

The pixel circuit PC may further include a first capacitor CST and a second capacitor CPR. The first capacitor CST includes a first electrode to which an initialization voltage VINIT is applied and a second electrode electrically connected to the first node. The second capacitor CPR includes a first electrode electrically connected to the output electrode of the third switching element T3 and a second electrode electrically connected to the data line DL1.

The pixel circuit PC is driven in a unit of a frame. The frame includes the on bias duration, the initial duration, the compensation duration, the first holding duration, the programming duration and the emission duration.

The first light emitting element OL1 of the pixel circuit PC may emit the light during a first frame and the second light emitting element OL2 of the pixel circuit PC may emit the light during a second frame. In a viewpoint of the entire display panel 100, red light emitting elements and blue light emitting elements of the display panel 100 emit the light during the first frame and green light emitting elements of the display panel 100 emit the light during the second frame.

The first frame and the second frame may be respectively referred as a first subframe and a second subframe.

According to some example embodiments, a waveform of the high power voltage ELVDD during the emission duration EMISSION of the first frame is different from a waveform of the high power voltage ELVDD during the emission duration EMISSION of the second frame.

During the emission duration EMISSION of the first frame, the high power voltage ELVDD has a first overdrive level which is greater than the high level. During the emission duration EMISSION of the second frame, the high power voltage ELVDD has a second overdrive level which is greater than the first over drive level. A duration when the high power voltage ELVDD has the first overdrive level may be referred as a first overdriving duration OVD1. A duration when the high power voltage ELVDD has the second overdrive level may be referred as a second overdriving duration OVD2.

During the emission duration EMISSION of the first frame, the first light emitting element OL1 emits the light. Herein the first light emitting element OL1 may be the red light emitting element or the blue light emitting element. During the emission duration EMISSION of the second frame, the second light emitting element OL2 emits the light. Herein the second light emitting element OL2 may be the green light emitting element.

During the emission duration EMISSION when the red light emitting elements and the blue light emitting elements emit the light, the high power voltage ELVDD may be overdriven (OVD1) by a relatively low overdrive level. In contrast, during the emission duration EMISSION when the green light emitting elements emit the light, the high power voltage ELVDD may be overdriven (OVD2) by a relatively high overdrive level.

The light emitting delay of the green light emitting element is greater than the light emitting delay of the red light emitting element and the light emitting delay of the blue light emitting element so that the degree of overdriving of the green light emitting element may be relatively high to prevent or reduce the stain.

In addition, the lifetime of the green light emitting element is longer than the lifetime of the red light emitting element and the lifetime of the blue light emitting element. Thus, the lifetime of the display apparatus may not be decreased although the degree of overdriving of the green light emitting element is relatively high.

In addition, luminance component of the green light emitting element may be greatest among luminance components of the red light emitting element, the green light emitting element and the blue light emitting element. Thus, when the stain of the green light emitting element is prevented or reduced, the stain of the display panel 100 in the low grayscale image may be effectively prevented or reduced.

A waveform of the high power voltage ELVDD in an initial period of the emission duration EMISSION of the first frame may have a plurality of pulses which have the first overdrive level.

In addition, a waveform of the high power voltage ELVDD in an initial period of the emission duration EMISSION of the second frame may have a plurality of pulses which have the second overdrive level.

For example, the pulses of the high power voltage ELVDD in the initial period of the emission duration EMISSION of the second frame may be more than the pulses of the high power voltage ELVDD in the initial period of the emission duration EMISSION of the first frame.

According to some example embodiments, the overdriven high power voltage is applied to the pixel circuit in the initial period of the emission duration EMISSION so that pixel uniformity may be enhanced in the low grayscale image. In addition, the degree of overdriving may be varied according to color of the light emitting elements so that the pixel uniformity may be enhanced, the light emitting delay of the specific color light emitting element may be enhanced and a decrease of the lifetime of the specific color light emitting element may be prevented. Thus, the display quality of the display panel 100 may be enhanced and the lifetime of the display apparatus may be increased.

Figure 12:
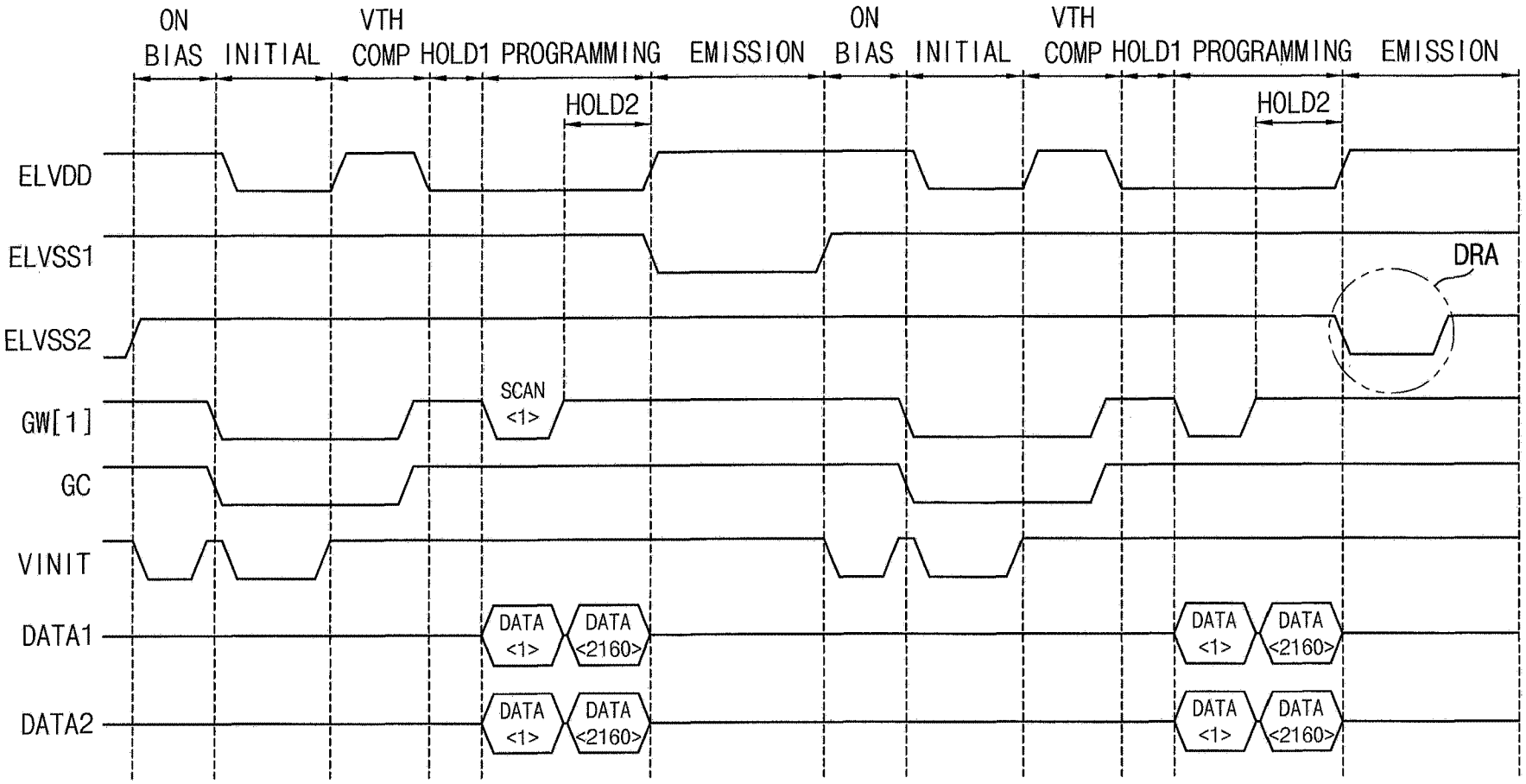
FIG. 12 is a timing diagram illustrating signals applied to a pixel circuit of a display apparatus according to some example embodiments of the present inventive concept.

FIG. 12 is a timing diagram illustrating signals applied to a pixel circuit of a display apparatus according to some example embodiments of the present inventive concept.

The display apparatus and the method of driving the display apparatus according to some example embodiments is substantially the same as the display apparatus and the method of driving the display apparatus of the previous example embodiment explained referring to FIGS. 1 to 10 except for the signals applied to the pixel circuit. Thus, the same reference numerals will be used to refer to the same or like parts as those described in the previous example embodiment of FIGS. 1 to 10 and some repetitive explanation concerning the above elements will be omitted.

Referring to FIGS. 1 to 3, 5 to 10 and 12, the display apparatus includes a display panel 100 and a display panel driver. The display panel driver includes a driving controller 200, a gate driver 300, a gamma reference voltage generator 400, a data driver 500 and a power voltage generator 600.

The pixel circuit PC includes a first light emitting element OL1 and a second light emitting element OL2. A first electrode of the first light emitting element OL1 is electrically connected to a first electrode of the second light emitting element OL2.

The pixel circuit PC may further include a first switching element T1, a second switching element T2 and a third switching element T3. The first switching element T1 includes a control electrode electrically connected to a first node, an input electrode to which the high power voltage ELVDD is applied and an output electrode electrically connected to the first electrode of the first light emitting element OL1. The second switching element T2 includes a control electrode to which a gate compensating signal GC is applied, an input electrode electrically connected to an output electrode of the third switching element T3 and an output electrode electrically connected to the first electrode of the first light emitting element OL1. The third switching element T3 includes a control electrode to which a gate writing signal GW is applied, an input electrode electrically connected to the first node and an output electrode electrically connected to the input electrode of the second switching element T2.

The pixel circuit PC may further include a first capacitor CST and a second capacitor CPR. The first capacitor CST includes a first electrode to which an initialization voltage VINIT is applied and a second electrode electrically connected to the first node. The second capacitor CPR includes a first electrode electrically connected to the output electrode of the third switching element T3 and a second electrode electrically connected to the data line DL1.

The pixel circuit PC is driven in a unit of a frame. The frame includes the on bias duration, the initial duration, the compensation duration, the first holding duration, the programming duration and the emission duration.

The first light emitting element OL1 of the pixel circuit PC may emit the light during a first frame and the second light emitting element OL2 of the pixel circuit PC may emit the light during a second frame. In a viewpoint of the entire display panel 100, red light emitting elements and blue light emitting elements of the display panel 100 emit the light during the first frame and green light emitting elements of the display panel 100 emit the light during the second frame. The first frame and the second frame may be respectively referred as a first subframe and a second subframe.

According to some example embodiments, a waveform of the first low power voltage ELVSS1 during the emission duration EMISSION of the first frame is different from a waveform of the second low power voltage ELVSS2 during the emission duration EMISSION of the second frame.

A width of a second low duration when the second low power voltage ELVSS2 has the low level in the emission duration EMISSION of the second frame may be less than a width of a first low duration when the first low power voltage ELVSS1 has the low level in the emission duration EMISSION of the first frame. The width of the second low duration less than the width of the first low duration may be referred as a duty ratio adjustment (DRA).

During the emission duration EMISSION of the first frame, the first light emitting element OL1 emits the light. Herein the first light emitting element OL1 may be the red light emitting element or the blue light emitting element. During the emission duration EMISSION of the second frame, the second light emitting element OL2 emits the light. Herein the second light emitting element OL2 may be the green light emitting element.

The data voltage VDATA applied to the green light emitting element may be greater than the data voltage VDATA applied to the red or blue light emitting element and the light emission period for the green light emitting element may be less than the light emission period for the red of blue light emitting element so that instances of the light emitting delay of the green light emitting element may be prevented or reduced and instances of the stain may be prevented or reduced.

In addition, luminance component of the green light emitting element may be the greatest among luminance components of the red light emitting element, the green light emitting element and the blue light emitting element. Thus, when the stain of the green light emitting element is prevented or reduced, the stain of the display panel 100 in the low grayscale image may be effectively prevented or reduced.

According to some example embodiments, the width of the second low duration of the second power voltage ELVSS2 may be reduced in the emission duration EMISSION and the data voltage VDATA applied to the green light emitting element may be increased so that the pixel uniformity may be enhanced in the low grayscale image. Thus, the display quality of the display panel 100 may be enhanced and the lifetime of the display apparatus may be increased.

According to the present inventive concept as explained above, the display quality of the display apparatus may be enhanced and the lifetime of the display apparatus may be increased.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel comprising a plurality of pixel circuits, a pixel circuit from among the pixel circuits comprising a first light emitting element and a second light emitting element; and a power voltage generator configured to:

apply a high power voltage to a first electrode of the first light emitting element and a first electrode of the second light emitting element;

apply a first low power voltage to a second electrode of the first light emitting element; and apply a second low power voltage to a second electrode of the second light emitting element, wherein the high power voltage has a high level, the first low power voltage has a low level and the second low power voltage has a high level during an emission duration of a first frame, wherein the high power voltage has the high level, the first low power voltage has a high level and the second low power voltage has a low level during an emission duration of a second frame, and wherein a waveform of the high power voltage in the emission duration of the first frame is different from a waveform of the high power voltage in the emission duration of the second frame.

2. The display apparatus of claim 1, wherein the high level of the high power voltage is maintained during the emission duration of the first frame, and wherein the high power voltage has an overdrive level greater than the high level in an initial period of the emission duration of the second frame.

3. The display apparatus of claim 2, wherein the first light emitting element is configured to emit light during the emission duration of the first frame, wherein the first light emitting element is a red light emitting element or a blue light emitting element, wherein the second light emitting element is configured to emit light during the emission duration of the second frame, and wherein the second light emitting element is a green light emitting element.

4. The display apparatus of claim 2, wherein the waveform of the high power voltage in the initial period of the emission duration of the second frame has a plurality of pulses having the overdrive level.

5. The display apparatus of claim 1, wherein the high power voltage has a first overdrive level greater than the high level in an initial period of the emission duration of the first frame, and wherein the high power voltage has a second overdrive level greater than the first overdrive level in an initial period of the emission duration of the second frame.

6. The display apparatus of claim 5, wherein the first light emitting element is configured to emit light during the emission duration of the first frame, wherein the first light emitting element is a red light emitting element or a blue light emitting element, wherein the second light emitting element is configured to emit light during the emission duration of the second frame, and wherein the second light emitting element is a green light emitting element.

7. The display apparatus of claim 5, wherein the waveform of the high power voltage in the initial period of the emission duration of the first frame has a plurality of pulses having the first overdrive level, and wherein the waveform of the high power voltage in the initial period of the emission duration of the second frame has a plurality of pulses having the second overdrive level.

8. The display apparatus of claim 1, wherein the pixel circuit further comprises:

a first switching element comprising a control electrode electrically connected to a first node, an input electrode configured to receive the high power voltage and an output electrode electrically connected to the first electrode of the first light emitting element;

a second switching element comprising a control electrode configured to receive a gate compensating signal, an input electrode electrically connected to an output electrode of a third switching element and an output electrode electrically connected to the first electrode of the first light emitting element; and the third switching element comprising a control electrode configured to receive a gate writing signal, an input electrode electrically connected to the first node and an output electrode electrically connected to the input electrode of the second switching element.

9. The display apparatus of claim 8, wherein the pixel circuit further comprises:

a first capacitor comprising a first electrode configured to receive an initialization voltage and a second electrode electrically connected to the first node; and a second capacitor comprising a first electrode electrically connected to the output electrode of the third switching element and a second electrode electrically connected to a data line.

10. The display apparatus of claim 1, wherein the display panel comprises:

a first subpixel row comprising a first subpixel which is a red subpixel, a second subpixel which is a green subpixel, a third subpixel which is a blue subpixel and a fourth subpixel which is a green subpixel; and a second subpixel row comprising a fifth subpixel which is a blue subpixel, a sixth subpixel which is a green subpixel, a seventh subpixel which is a red subpixel and an eighth subpixel which is a green subpixel.

11. The display apparatus of claim 10, wherein the display panel further comprises:

a first data line electrically connected to the first subpixel, the second subpixel, the fifth subpixel, and the sixth subpixel, and a second data line electrically connected to the third subpixel, the fourth subpixel, the seventh subpixel, and the eighth subpixel.

12. The display apparatus of claim 1, wherein the high power voltage has a low level, the first low power voltage has the high level and the second low power voltage has the high level during a programming duration of the first frame which precedes the emission duration of the first frame.

13. The display apparatus of claim 12, wherein the high power voltage has the low level, the first low power voltage has the high level, and the second low power voltage has the high level during an on bias duration of the second frame which is subsequent to the emission duration of the first frame.

14. A display apparatus comprising:

a display panel comprising a plurality of pixel circuits, the pixel circuit comprising a first light emitting element and a second light emitting element; and a power voltage generator configured to:

apply a high power voltage to a first electrode of the first light emitting element and a first electrode of the second light emitting element;

apply a first low power voltage to a second electrode of the first light emitting element; and apply a second low power voltage to a second electrode of the second light emitting element, wherein the high power voltage has a high level, the first low power voltage has a low level and the second low power voltage has a high level during an emission duration of a first frame, wherein the high power voltage has the high level, the first low power voltage has a high level and the second low power voltage has a low level during an emission duration of a second frame, and wherein a waveform of the first low power voltage in the emission duration of the first frame is different from a waveform of the second low power voltage in the emission duration of the second frame.

15. The display apparatus of claim 14, wherein a width of a second low duration when the second low power voltage has the low level in the emission duration of the second frame is less than a width of a first low duration when the first low power voltage has the low level in the emission duration of the first frame.

16. The display apparatus of claim 15, wherein the first light emitting element is configured to emit light during the emission duration of the first frame, wherein the first light emitting element is a red light emitting element or a blue light emitting element, wherein the second light emitting element emits light during the emission duration of the second frame, and wherein the second light emitting element is a green light emitting element.

17. A method of driving a display apparatus, the method comprising:

applying a high power voltage to a first electrode of a first light emitting element and a first electrode of a second light emitting element;

applying a first low power voltage to a second electrode of the first light emitting element; and applying a second low power voltage to a second electrode of the second light emitting element, wherein the high power voltage has a high level, the first low power voltage has a low level and the second low power voltage has a high level during an emission duration of a first frame, wherein the high power voltage has the high level, the first low power voltage has a high level and the second low power voltage has a low level during an emission duration of a second frame, and wherein a waveform of the high power voltage in the emission duration of the first frame is different from a waveform of the high power voltage in the emission duration of the second frame.

18. The method of claim 17, wherein the high level of the high power voltage is maintained during the emission duration of the first frame, and wherein the high power voltage has an overdrive level greater than the high level in an initial period of the emission duration of the second frame.

19. The method of claim 17, wherein the high power voltage has a first overdrive level greater than the high level in an initial period of the emission duration of the first frame, and wherein the high power voltage has a second overdrive level greater than the first overdrive level in an initial period of the emission duration of the second frame.

20. The method of claim 17, wherein the display apparatus comprises a pixel circuit comprising:

the first light emitting element;

the second light emitting element;

a first switching element comprising a control electrode electrically connected to a first node, an input electrode configured to receive the high power voltage and an output electrode electrically connected to the first electrode of the first light emitting element;

a second switching element comprising a control electrode configured to receive a gate compensating signal, an input electrode electrically connected to an output electrode of a third switching element and an output electrode electrically connected to the first electrode of the first light emitting element; and the third switching element comprising a control electrode configured to receive a gate writing signal, an input electrode electrically connected to the first node and an output electrode electrically connected to the input electrode of the second switching element.

* * * * *